US008521049B2

(12) United States Patent
Chosokabe et al.

(10) Patent No.: US 8,521,049 B2
(45) Date of Patent: Aug. 27, 2013

(54) HEATER CONTROLLER, IMAGE FORMING APPARATUS, METHOD FOR CONTROLLING HEATER

(75) Inventors: Kiriko Chosokabe, Tokyo (JP); Eiji Nemoto, Tokyo (JP)

(73) Assignee: Ricoh Company, Limited, Tokyo (JP)

( * ) Notice: Subject to any disclaimer, the term of this patent is extended or adjusted under 35 U.S.C. 154(b) by 226 days.

(21) Appl. No.: 13/038,517

(22) Filed: Mar. 2, 2011

(65) Prior Publication Data

US 2011/0217062 A1 Sep. 8, 2011

(30) Foreign Application Priority Data

Mar. 5, 2010 (JP) ..... 2010-049648

(51) Int. Cl.
*G03G 15/20* (2006.01)

(52) U.S. Cl.
USPC ..... 399/67; 399/88

(58) Field of Classification Search
USPC ..... 399/67, 88
See application file for complete search history.

(56) References Cited

U.S. PATENT DOCUMENTS

| | | | | |
|---|---|---|---|---|
| 5,994,671 | A * | 11/1999 | Suzuki et al. | 219/216 |
| 6,490,423 | B2 * | 12/2002 | Horobin et al. | 399/67 |
| 6,730,886 | B2 * | 5/2004 | Cho et al. | 219/497 |
| 6,853,818 | B2 * | 2/2005 | Nishida | 399/67 |
| 6,901,226 | B2 * | 5/2005 | Claassen | 399/67 |
| 7,511,727 | B2 * | 3/2009 | Nishida | 347/156 |
| 7,599,636 | B2 * | 10/2009 | Kaji et al. | 399/69 |
| 7,970,309 | B2 * | 6/2011 | Sato et al. | 399/69 |
| 8,244,150 | B2 * | 8/2012 | Kumada et al. | 399/69 |
| 8,260,165 | B2 * | 9/2012 | Chosokabe et al. | 399/67 |
| 2003/0103778 | A1 * | 6/2003 | Meads et al. | 399/88 |
| 2006/0051118 | A1 * | 3/2006 | Kaji et al. | 399/69 |
| 2007/0116485 | A1 | 5/2007 | Nishida | |
| 2010/0239301 | A1 | 9/2010 | Nemoto et al. | |

(Continued)

FOREIGN PATENT DOCUMENTS

| | | |
|---|---|---|
| CN | 1806209 | 7/2006 |
| EP | 0 797 130 A2 | 9/1997 |

(Continued)

OTHER PUBLICATIONS

Extended European Search Report issued May 26, 2011, in Patent Application No. 11156715.2.

Office Action mailed Apr. 23, 2013, in Chinese Patent Application No. 201110053600.0, pp. 1-14, (w/English translation).

*Primary Examiner* — G. M. Hyder

(74) *Attorney, Agent, or Firm* — Oblon, Spivak, McClelland, Maier & Neustadt, L.L.P.

(57) ABSTRACT

A heater controller performs on/off control of a plurality of heaters and includes a storage unit that stores therein a plurality of pattern sets. Each of the pattern sets includes a plurality of heater-on/off patterns for respectively controlling the heaters. The heater controller calculates a reference value representing an average of values of electric power supplied to the heater controller over a predetermined period of time; calculates, for each of the pattern sets, an output power value to be supplied to the heaters when the heaters are turned-on according to the heater-on/off patterns included in the pattern set; calculates, for each of the pattern sets, a difference between the reference value and the output power value; selects, from the pattern sets, one pattern set having a smallest difference; and performs on/off control of the heaters according to the heater-on/off patterns included in the pattern set thus selected.

11 Claims, 11 Drawing Sheets

(56) References Cited

U.S. PATENT DOCUMENTS

| | | | | |
|---|---|---|---|---|
| 2010/0247131 | A1* | 9/2010 | Sato et al. | 399/70 |
| 2010/0310267 | A1* | 12/2010 | Shimura et al. | 399/69 |
| 2010/0322656 | A1* | 12/2010 | Chosokabe et al. | 399/67 |
| 2010/0322657 | A1* | 12/2010 | Kumada et al. | 399/69 |
| 2011/0064444 | A1* | 3/2011 | Adachi et al. | 399/69 |

FOREIGN PATENT DOCUMENTS

| | | | |
|---|---|---|---|
| EP | 1 632 822 | A2 | 3/2006 |
| EP | 2 296 057 | A2 | 3/2011 |
| JP | 11-339930 | | 12/1999 |
| JP | 2008-191333 | | 8/2008 |

* cited by examiner

| | | | | | | | | | | | |
|---|---|---|---|---|---|---|---|---|---|---|---|
| OUTPUT POWER OF HEATER 1 [W] | 0 | 700 | 700 | 700 | 700 | 0 | 700 | 700 | 700 | 700 | 402 |
| OUTPUT POWER OF HEATER 2 [W] | 500 | 125 | 125 | 125 | 125 | 500 | 125 | 125 | 125 | 125 | 405 |
| TOTAL OUTPUT POWER OF HEATERS 1 AND 2 [W] | 500 | 825 | 825 | 825 | 825 | 500 | 825 | 825 | 825 | 825 | 406 |
| POWER DIFFERENCE [W] FROM REFERENCE POWER 760 [W] | 260 | 65 | 65 | 65 | 65 | 260 | 65 | 65 | 65 | 65 | 407 |
| TOTAL POWER DIFFERENCE [W] | 1040 | | | | | | | | | | 408 |

PATTERN SET B

| | | | | | | | | | | | |
|---|---|---|---|---|---|---|---|---|---|---|---|
| OUTPUT POWER OF HEATER 1 [W] | 700 | 350 | 700 | 700 | 350 | 700 | 350 | 700 | 700 | 350 | 402 |
| OUTPUT POWER OF HEATER 2 [W] | 0 | 500 | 0 | 0 | 500 | 0 | 500 | 0 | 0 | 500 | 405 |
| TOTAL OUTPUT POWER OF HEATERS 1 AND 2 [W] | 700 | 850 | 700 | 700 | 850 | 700 | 850 | 700 | 700 | 850 | 406 |
| POWER DIFFERENCE [W] FROM REFERENCE POWER 760 [W] | 60 | 90 | 60 | 60 | 90 | 60 | 90 | 60 | 60 | 90 | 407 |
| TOTAL POWER DIFFERENCE [W] | 720 | | | | | | | | | | 408 |

| FIXATION-HEATER POWER CONSUMPTION [W] | VOLTAGE DROP AMOUNT [V] |
|---|---|
| 800 | 3.1 |
| 700 | 3.0 |
| 600 | 2.9 |
| 500 | 2.8 |
| 400 | 2.7 |
| 300 | 2.6 |
| 200 | 2.5 |
| 100 | 2.4 |

FIG. 9

| DUTY [%] | TURN-ON COEFFICIENT |
|---|---|
| 10 | 1.45 |
| 20 | 1.40 |
| 30 | 1.35 |
| 40 | 1.30 |
| 50 | 1.25 |
| 60 | 1.20 |
| 70 | 1.15 |
| 80 | 1.10 |
| 90 | 1.05 |
| 100 | 1.00 |

FIG. 10

| ENVIRONMENTAL TEMPERATURE [°C] | TEMPERATURE COEFFICIENT |
|---|---|
| ≤ 0°C | 1.1 |
| >0°C, <30°C | 1.0 |
| ≥30°C | 0.9 |

FIG. 14

| No | VOLTAGE DROP AMOUNT [V] |
|---|---|
| 1 | 3.72 |
| 2 | 0 |
| 3 | 3.72 |
| 4 | 3.72 |
| 5 | 0 |
| 6 | 3.72 |
| 7 | 0 |
| 8 | 3.72 |
| 9 | 3.72 |
| 10 | 0 |
| TOTAL | 2.232 |

HEATER CONTROLLER, IMAGE FORMING APPARATUS, METHOD FOR CONTROLLING HEATER

CROSS-REFERENCE TO RELATED APPLICATIONS

The present application claims priority to and incorporates by reference the entire contents of Japanese Patent Application No. 2010-049648 filed in Japan on Mar. 5, 2010.

BACKGROUND OF THE INVENTION

1. Field of the Invention

The present invention is directed generally to a heater controller, an image forming apparatus, and a method for on/off control of heaters.

2. Description of the Related Art

Electrophotographic image forming apparatuses typically include a heater, such as a halogen heater, that produces relatively large inrush current as a fixing heater. The fixing heater is desirably controlled so as to lessen flicker because a ratio of electric power used to perform fixation to electric power consumption of the image forming apparatus is typically large.

Flicker measurement is performed by using a flickermeter complying with the standard, IEC 61000-4-15. A flicker value is a quantified value representing degree of visual sensation of flicker annoyance and calculated from a voltage drop, which occurs under actual heater control, relative to a reference voltage or frequency components of voltage waveform. The reference voltage is an average of supply voltages applied to an image forming apparatus over one minute. As the difference between the reference voltage and a dropped voltage after voltage drops due to electric power consumption in the apparatus decreases, the flicker value representing degree of annoyance perception decreases (the degree of flicker is favorably low).

As control schemes for flicker reduction, there are known half-wave control of performing heater-on/off control of a heater according to a heater-on/off pattern in a unit of 10 half-waves, and phase control under which a heater is turned on for only a part of a half-wave and the on-time is made gradually longer. For instance, disclosed in Japanese Patent Application Laid-open No. 2008-191333 is a technique for controlling heaters in this way: when a turn-on duty in a unit of two half-waves of a main heater and a sub heater is greater than 50%, a full turn-on is allocated to one half wave out of the two half waves of each of the heaters such that simultaneous full turn-ons of the main heater and the sub heater does not occur.

However, such a technique as that disclosed in Japanese Patent Application Laid-open No. 2008-191333 for controlling a plurality of heaters is disadvantageous in that a voltage drop can be high when difference between the heaters in electrical power is large or electrical power of the heaters is large. This can increase the difference in voltage from a reference voltage, thereby undesirably increasing flicker value.

SUMMARY OF THE INVENTION

It is an object of the present invention to at least partially solve the problems in the conventional technology.

According to an aspect of the present invention, there is provided a heater controller that performs on/off control of a plurality of heaters. The heater controller includes a storage unit that stores therein a plurality of pattern sets, wherein each of the pattern sets includes a plurality of heater-on/off patterns for respectively controlling the heaters, and each of the heater-on/off patterns is set in terms of a predetermined control period; a reference-value calculating unit that calculates a reference value representing an average of values of electric power supplied to the heater controller over a predetermined period of time; an output-value calculating unit that calculates, for each of the pattern sets, an output power value to be supplied to the heaters when the heaters are turned-on according to the heater-on/off patterns included in the pattern set; a difference calculating unit that calculates, for each of the pattern sets, a difference between the reference value and the output power value; a selecting unit that selects, from the pattern sets, one pattern set having a smallest difference; and an on/off control unit that performs on/off control of the heaters according to the heater-on/off patterns included in the pattern set selected by the selecting unit, respectively.

According to another aspect of the present invention, there is provided a heater control method to be performed by a heater controller to perform on/off control of a plurality of heaters. The heater controller includes a storage unit. The heater control method includes storing, in the storage unit, a plurality of pattern sets, wherein each of the pattern sets includes a plurality of heater-on/off patterns for respectively controlling the heaters, and each of the heater-on/off patterns is set in terms of a predetermined control period; calculating a reference value representing an average of values of electric power supplied to the heater controller over a predetermined period of time; calculating, for each of the pattern sets, an output power value to be supplied to the heaters when the heaters are turned-on according to the heater-on/off patterns included in the pattern set; calculating, for each of the pattern sets, a difference between the reference value and the output power value; selecting, from the pattern sets, one pattern set having the smallest difference; and performing on/off control of the heaters according to the heater-on/off patterns included in the pattern set selected at the selecting, respectively.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 9 is a diagram illustrating an example of a turn-on coefficient table;

FIG. 10 is a diagram illustrating an example of a temperature coefficient table;

FIG. 14 is a diagram illustrating exemplary calculation of an average voltage drop amount over the one control period illustrated in FIG. 13.

DETAILED DESCRIPTION OF THE PREFERRED EMBODIMENTS

Exemplary embodiments of the present invention are described in detail below with reference to the accompanying drawings. An image forming apparatus according to an aspect of the invention is applicable to any image forming apparatus, such as a multifunction peripheral having at least two functions of a copier function, a printer function, a scanner function, and a facsimile function.

First Embodiment

There is a scheme for performing heater-on/off control of two heaters, in which a heater with a higher turn-on duty is subjected to half-wave control, and the other heater is subjected to half-wave phase control that is a combination of half-wave control and phase control. Although this scheme advantageously reduces inrush current, this scheme can disadvantageously produce a high voltage drop in a situation where difference between the heaters in electrical power is large or electrical power of the heaters is large as discussed above. This can lead to a large voltage difference from a reference voltage, thereby undesirably increasing flicker value.

Figure 1:
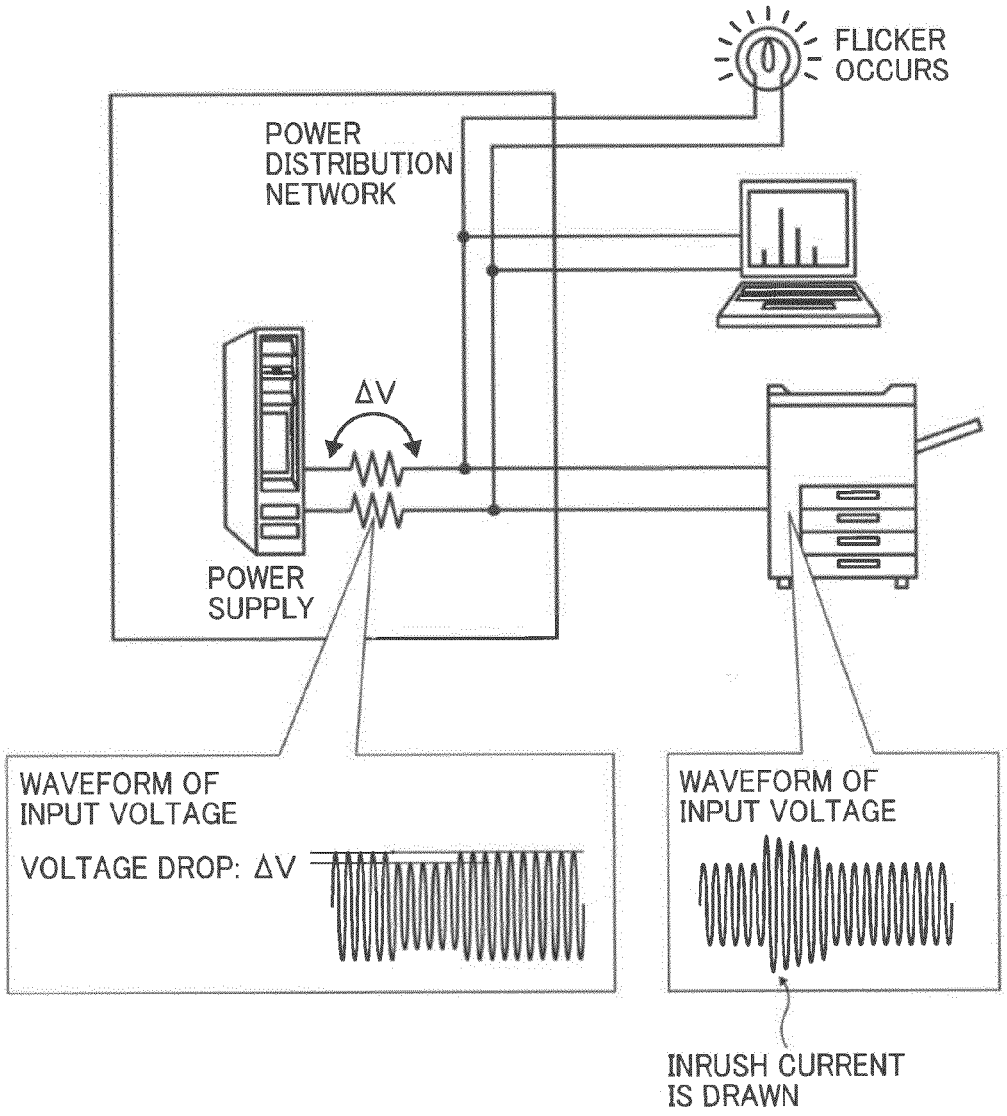
FIG. 1 is an explanatory diagram of a cause of a voltage drop.

A cause of a voltage drop is discussed below with reference to FIG. 1. A power supply line connected to equipment, such as an image forming apparatus, has impedance. Accordingly, large electric current consumption produces a high voltage drop at wiring portion, resulting in a voltage drop of the power supply. This can cause a room fluorescent light or the like to flicker, inducing annoying visual sensation. To avoid such a circumstance, there is instituted a flicker regulation to limit voltage variations caused by operations of equipment.

A ratio of electric power required for fixation (hereinafter, "fixation-heater power consumption") to electric power consumption of an image forming apparatus is typically large. Halogen heaters, currently being majority of fixing heaters, are likely to create a voltage drop of a power supply line of the image forming apparatus. Under such a circumstance, contrivance to reduce voltage variations relative to a reference voltage, based on which flicker measurement is to be performed, has conventionally been made by typically improving power supply control performed by a device, such as a fixation-heater on/off controller.

The reference voltage can vary depending on an operation mode of equipment. Examples of the operation mode include a warm-up mode, a return-from-energy-saving mode, an operating mode, a stand-by mode, and an energy-saving mode. Scheme for switching heater control depending on such variation in reference voltage has not been devised. This is because it is generally difficult for equipment to perform electric power control in a manner as to reduce flicker value while checking a reference voltage because the reference voltage is obtained at fixed time intervals over a period where flicker measurement is performed.

Hence, an image forming apparatus according to a first embodiment of the present invention employs a heater control method for reducing voltage variations relative to a reference voltage that can vary depending on an operation mode of the apparatus. The heater control method includes calculating a reference value corresponding to the reference voltage for use in flicker measurement and performing control so as to reduce a difference from the thus-calculated reference value. In the first embodiment, the reference value, the difference, and the like are calculated by using electric power in lieu of voltage because an electric power value of heater and a voltage drop amount are in a proportional relationship. This eliminates the need of converting a electric power value of heater into a voltage drop amount.

More specifically, the image forming apparatus according to the first embodiment calculates a reference value (reference power value) at predetermined time intervals (one minute) defined in the standard as a period, over which flicker is to be measured. The reference value represents an average of values of electric power supplied to the image forming apparatus over the predetermined period of time. The image forming apparatus calculates, for each of heater-on/off patterns for use in controlling a plurality of heaters, a total (total power difference) of per-half-wave differences between output values (output power values) and the reference power value in each control period of the heater, each of the output power values representing electrical power that is output under each heater control. The image forming apparatus performs heater control by using an on/off pattern with which the total power difference is small.

In an example discussed below, two fixing heaters are controlled by using two heater-on/off patterns, respectively, one of which uses half-wave control method and the other uses half-wave phase control method. The heater-on/off patterns are not limited thereto, and a plurality of mutually different patterns for controlling a plurality of heaters can be employed. More specifically, the method according to the first embodiment allows a plurality of heaters to be controlled under different control schemes. Furthermore, any control schemes are usable in this method so long as it is allowed to calculate values of output electric power (hereinafter, "output power values") to be obtained by the control schemes.

Figure 2:
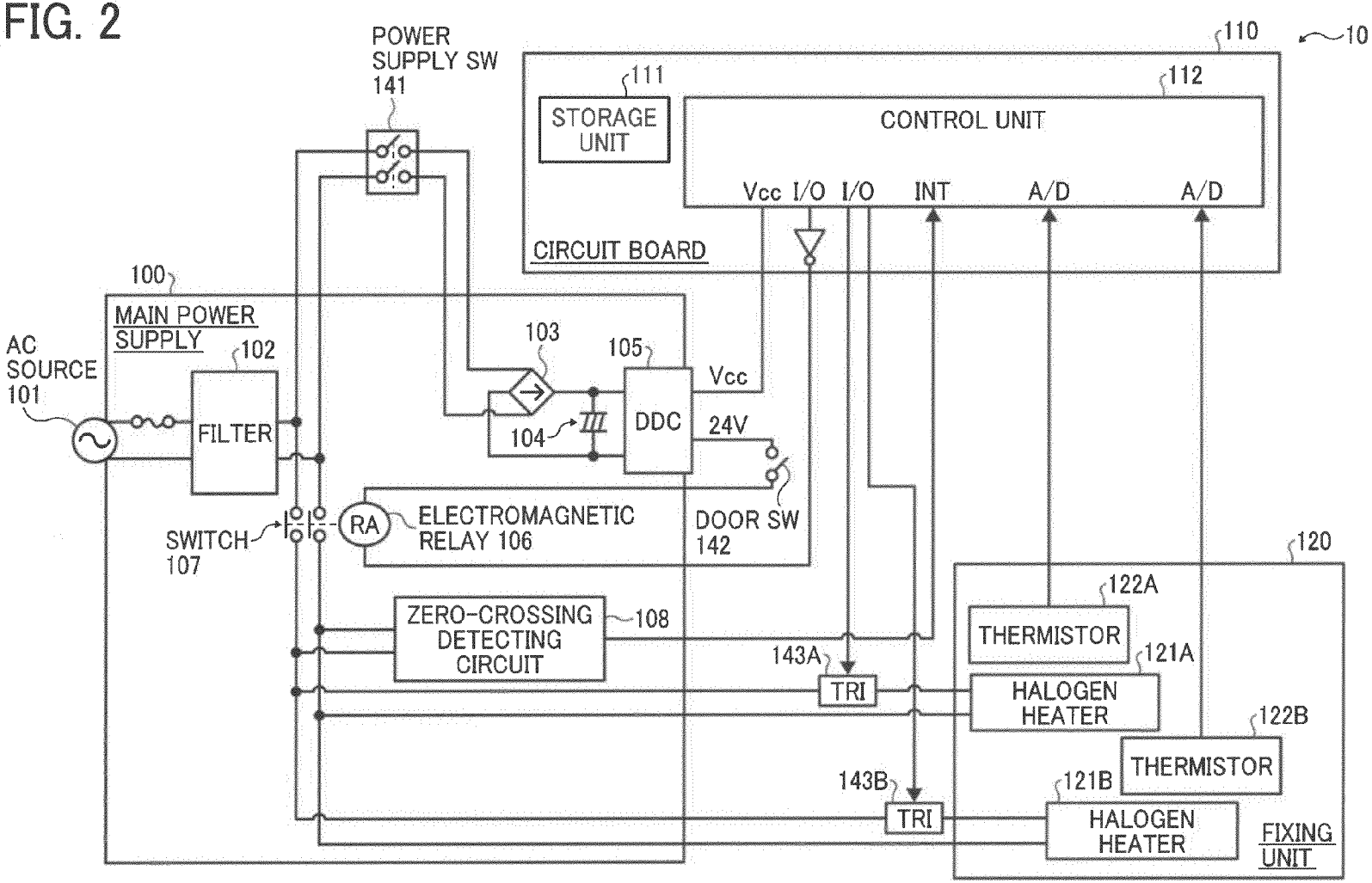
FIG. 2 is a block diagram illustrating the overall configuration of an image forming apparatus according to a first embodiment of the present invention.

FIG. 2 is a block diagram illustrating an overall configuration of an image forming apparatus 10 of the first embodiment. The image forming apparatus 10 includes a heater controller that controls heaters of a fixing unit and the like, provided in the image forming apparatus 10. The image forming apparatus 10 mainly includes a main power supply 100 and a circuit board 110. The image forming apparatus 10 further includes a fixing unit 120, a power supply switch (SW) 141, a door switch (SW) 142, a triac (TRI) 143A, and a triac (TRI) 143B.

The fixing unit 120 includes two halogen heaters, or, more specifically, a halogen heater 121A and a halogen heater 121B. The fixing unit 120 further includes a thermistor 122A and a thermistor 122B arranged near the halogen heater 121A and the halogen heater 121B, respectively.

The circuit board 110 controls the overall image forming apparatus 10. The circuit board 110 is implemented as a computer, to which a central processing unit (CPU), a random access memory (RAM), a read only memory (ROM), a non-volatile RAM (NVRAM), application specific integrated circuit (ASIC), and an input/output interface (I/F), which are not shown, are connected through bus.

The circuit board 110 controls, in addition to the main power supply 100, on and off of the TRIs 143A and 143B and an electromagnetic relay 106 provided between the main power supply 100 and the fixing unit 120, thereby performing temperature control and on/off control of the halogen heaters 121A and 121B of the fixing unit 120. Other heaters, such as ceramic heaters, can be used in lieu of the halogen heaters 121A and 121B.

The thermistor 122A arranged near the halogen heater 121A detects surface temperature of the halogen heater 121A. Similarly, the thermistor 122B arranged near the halogen heater 121B detects surface temperature of the halogen heater 121B. The circuit board 110 performs analog-to-digital (A/D) conversion of the surface temperature detected by the thermistor 122A to obtain the surface temperature of the halogen heater 121A. Similarly, the circuit board 110 performs A/D conversion of the surface temperature detected by the thermistor 122B to obtain the surface temperature of the halogen heater 121B. The circuit board 110 performs on/off control of the TRIs 143A and 143B and the electromagnetic relay 106 to stabilize the surface temperature of the halogen heater 121A and that of the halogen heater 121B.

When the power supply SW 141 of the image forming apparatus 10 is switched on, electric current supplied from an alternating-current (AC) source 101 undergoes noise reduction performed with a filter 102 and thereafter smoothing performed with a rectifier diode 103 and a smoothing capacitor 104. The electric current is then supplied to a digital down converter (DDC) 105. The DDC 105, being a switching direct-current (DC)-DC converter, applies a constant voltage Vcc to the circuit board 110 and a voltage of 24 V to the electromagnetic relay 106.

The electromagnetic relay 106 is operable to switch on a switch 107 and similarly switch off the fixing unit 120 via the circuit board 110 when the door SW 142 of the image forming apparatus 10 is switched on. In other words, the electromagnetic relay 106 serves as a safety lock mechanism of the fixing unit 120.

A zero-crossing detecting circuit 108 detects a zero crossing point pertaining to the AC source 101. The circuit board 110 switches on and off the TRIs 143A and 143B in response to detection of the zero-crossing point. With the switch 107 on, the alternating current supplied to the zero-crossing detecting circuit 108 crosses a zero-voltage point every half wave. This makes it impossible for a transistor of the zero-crossing detecting circuit 108 to maintain on-state voltage. Upon detecting this state of the transistor, the zero-crossing detecting circuit 108 outputs a zero-crossing signal to the circuit board 110. In phase control, the phase control is performed in response to detection of the zero-crossing signals.

The circuit board 110 includes a storage unit 111 and a control unit 112. The control unit 112 performs on/off control of the halogen heaters 121A and 121B.

More specifically, the control unit 112 determines a turn-on duty of the halogen heater 121A based on the surface temperature of the halogen heater 121A detected by the thermistor 122A and a target temperature of the same. Similarly, the control unit 112 determines a turn-on duty of the halogen heater 121B based on the surface temperature of the halogen heater 121B detected by the thermistor 122B and a target temperature of the same. The control unit 112 performs on/off control of each of the halogen heaters 121A and 121B, on a per-half-wave basis, according an on/off pattern given thereto according to the thus-determined turn-on duty. A half-wave is a half of one cycle of an AC voltage. Functions of the control unit 112 can be implemented, for instance, by causing software to be executed on the CPU. The functions of the control unit 112 will be discussed in detail later.

The storage unit 111 stores therein various information pieces for use in on/off control of the halogen heaters 121A and 121B. For instance, the storage unit 111 stores therein on/off patterns, each of which is set in terms of a predetermined control period. The storage unit 111 also stores therein voltage values, which will be discussed later, calculated by the control unit 112.

The control period is a period corresponding to an integral multiple of voltage period of the AC source 101 controlled by the circuit board 110, and is a period of a predetermined length. In the first embodiment, it is assumed that the control period is set to 10 half-waves. Under this assumption, the storage unit 111 stores therein on/off patterns in which the control period is set to 10 half-waves. In the first embodiment, the storage unit 111 stores therein a plurality of pattern sets associated with each turn-on duty. Each of the plurality of pattern sets includes two on/off patterns differing from each other in control scheme for respectively controlling the halogen heaters 121A and 121B. An example where two pattern sets are stored associated with each turn-on duty is discussed below. Alternatively, three pattern sets can be stored associated with each turn-on duty. Note that the control period is not limited to 10 half-waves. Alternatively, the control period may be, for instance, an integral multiple of 10 half-waves.

Figure 3:
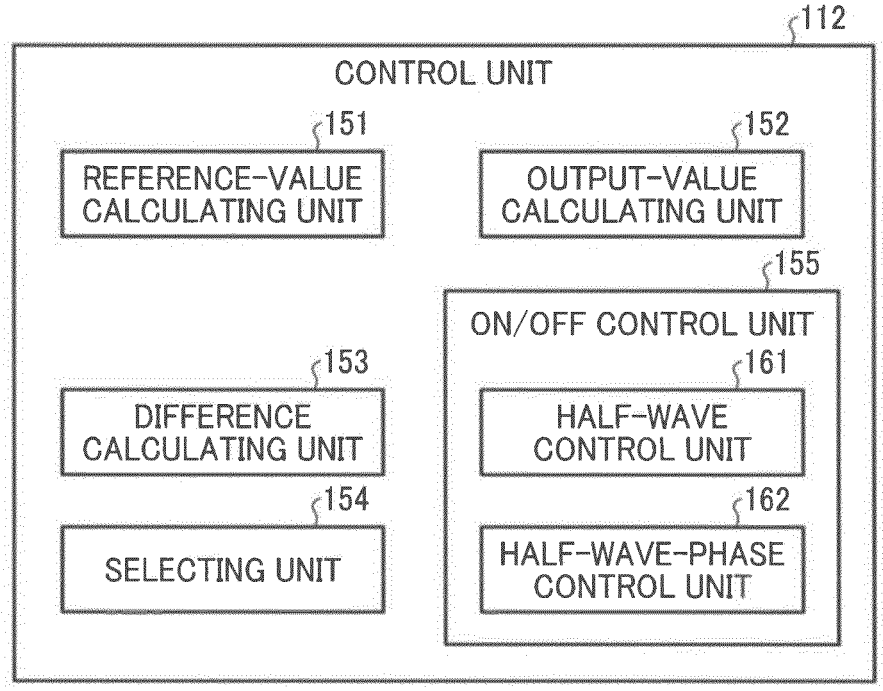
FIG. 3 is a functional block diagram illustrating exemplary functions of a control unit according to the first embodiment.

FIG. 3 is a functional block diagram illustrating exemplary functions of the control unit 112 according to the first embodiment. As illustrated in FIG. 3, the control unit 112 includes, as relevant functional elements, a reference-value calculating unit 151, an output-value calculating unit 152, a difference calculating unit 153, a selecting unit 154, and an on/off control unit 155.

The reference-value calculating unit 151 calculates a reference value of electric power (hereinafter, "reference power value") representing an average of values of electric power to be supplied to the image forming apparatus over a predetermined period of time. In the first embodiment, the predetermined period of time is one minute, being a period of time defined for flicker measurement in IEC61000-4-15. However, the predetermined period of time is not limited thereto, and can be set to any appropriate value according to a flicker measurement method. The thus-calculated reference power value is stored in, for instance, the storage unit 111.

The output-value calculating unit 152 calculates, for each half-wave in one control period, output power values to be supplied to the halogen heaters 121A and 121B when the heaters are turned-on according to the on/off patterns included in each of the two pattern sets. The thus-calculated output power values are stored in, for instance, the storage unit 111.

The difference calculating unit 153 calculates, for each of four on/off patterns included in the two pattern sets, differences between the reference power value calculated by the reference-value calculating unit 151 and the respective output power values calculated by the output-value calculating unit 152.

The selecting unit 154 selects a pattern set whose total of the differences calculated by the difference calculating unit 153 is smaller. For instance, the selecting unit 154 selects, from the two pattern sets, one pattern set whose total of the differences is smaller. If there are three or more pattern sets, the selecting unit 154 selects one pattern set whose total of the differences is smallest.

The on/off control unit 155 performs on/off control of the halogen heaters 121A and 121B according to two on/off patterns included in the thus-selected pattern set. The on/off control unit 155 includes a half-wave control unit 161 that performs half-wave control and a half-wave-phase control unit 162 that performs half-wave phase control. The half-wave control and the half-wave phase control are fixation control schemes. In the first embodiment, two pattern sets each including two on/off patterns are stored in the storage unit 111 in advance, and the halogen heaters 121A and 121B are controlled by using the two on/off patterns, one of which uses half-wave control method and the other uses half-wave phase control method. The on/off control unit 155 performs on/off control of the halogen heaters 121A and 121B according to two on/off patterns included in a selected one of the two pattern sets.

Figure 4:
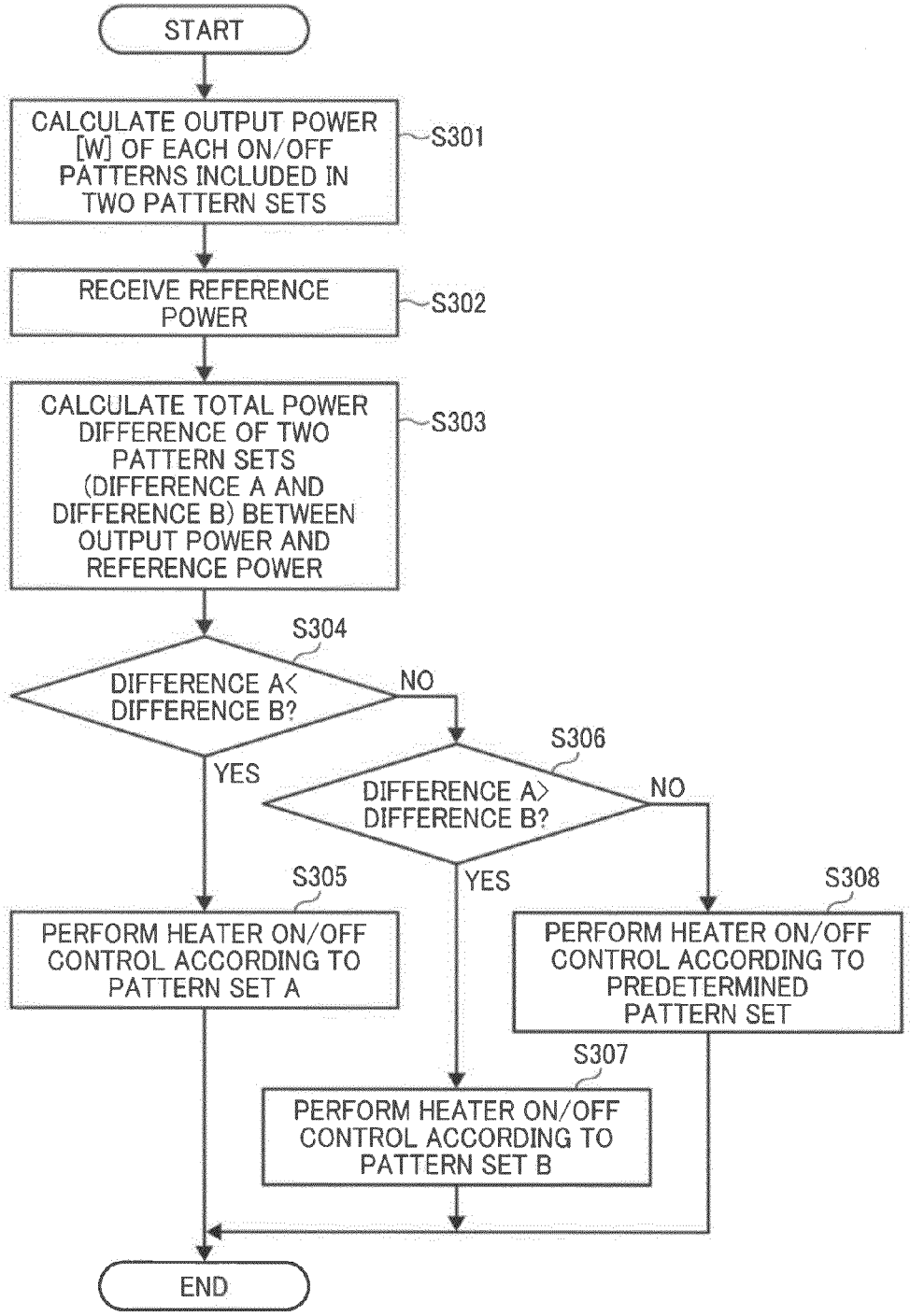
FIG. 4 is a flowchart illustrating an example procedure for a heater control process to be performed in the image forming apparatus.

A heater control process to be performed in the image forming apparatus 10 according to the first embodiment configured as mentioned above is discussed below with reference to FIG. 4. FIG. 4 is a flowchart illustrating an example procedure for the heater control process to be performed by the image forming apparatus 10. FIG. 4 illustrates the process where a turn-on duty of each heater is determined according to a detected surface temperature of the heater; thereafter one pattern set is selected from two pattern sets (hereinafter, "pattern set A and pattern set B") that are determined based on the thus-determined turn-on duty; and on/off control of the heaters is performed according to the selected one of the pattern sets.

In this example, the pattern A includes two on/off patterns, one of which is used for half-wave control to be applied to a heater 1 and the other is used for half-wave phase control to be applied to a heater 2; the pattern B includes two on/off patterns, one of which is used for half-wave phase control to be applied to the heater 1 and the other is used for half-wave control to be applied to the heater 2. The heater 1 and the heater 2 correspond to, for example, the halogen heater 121A and the halogen heater 121B, respectively.

The output-value calculating unit 152 calculates, for each half-wave of an AC source (e.g., at every 10 milliseconds (ms) when a 50-Hz AC source is employed) in one control period, output power values of each of the on/off patterns (Step S301). The difference calculating unit 153 receives the reference power value calculated by the reference-value calculating unit 151 (Step S302).

The reference-value calculating unit 151 calculates, at desired intervals, the reference power value representing an average of values of electric power supplied to the image forming apparatus over one minute. For instance, the reference-value calculating unit 151 calculates, at intervals of the control period, the reference power value representing an average of values of electric power supplied to the apparatus over latest one minute. The difference calculating unit 153 receives the reference power value calculated as mentioned above by the reference-value calculating unit 151 from the storage unit 111.

The difference calculating unit 153 calculates differences between the reference power value and the respective output power values calculated at Step S301 (Step S303) in each of the on/off patterns. More specifically, the difference calculating unit 153 calculates absolute values of per-half-wave differences between the reference power value and the respective output power values in each of the on/off patterns. The difference calculating unit 153 calculates a sum of the per-half-wave differences over one control period and outputs a value of the sum as a total power difference per control period. The total power difference obtained from the pattern set A is referred to as a difference A, and that obtained from the pattern set B is referred to as a difference B.

Subsequently, the selecting unit 154 compares the total power differences calculated for the respective pattern sets and selects a pattern set whose total power difference is smaller. More specifically, the selecting unit 154 determines whether the difference A is smaller than the difference B (Step 304). If the difference A is smaller than the difference B (YES at Step 304), the selecting unit 154 selects the pattern A. The on/off control unit 155 performs on/off control of the heater 1 and the heater 2 (the halogen heaters 121A and 121B) according to the thus-selected pattern set A (Step S305).

If the difference A is not smaller than the difference B (NO at Step 304), the selecting unit 154 further determines whether the difference A is greater than the difference B (Step S306). If the difference A is greater than the difference B (YES at Step 306), the selecting unit 154 selects the pattern set B. The on/off control unit 155 performs on/off control of the heater 1 and the heater 2 (the halogen heaters 121A and 121B) according to the thus-selected pattern set B (Step S307).

If the difference A is not greater than the difference B (NO at Step 306), or, put another way, the difference A is equal to the difference B, the selecting unit 154 determines an on/off pattern according to other criterion. For instance, the selecting unit 154 can select a pattern set in which half-wave control is assigned to one heater, of the two heaters, having smaller turn-on ratio (turn-on duty). Alternatively, the selecting unit 154 can select a pattern set in which half-wave control is assigned to a heater having smaller power consumption. Further alternatively, the selecting unit 154 can select a pattern set having been selected for an immediately preceding control period. The on/off control unit 155 performs on/off control of the heater 1 and the heater 2 (the halogen heaters 121A and 121B) according to the thus-selected pattern set (Step S308).

Figure 5:
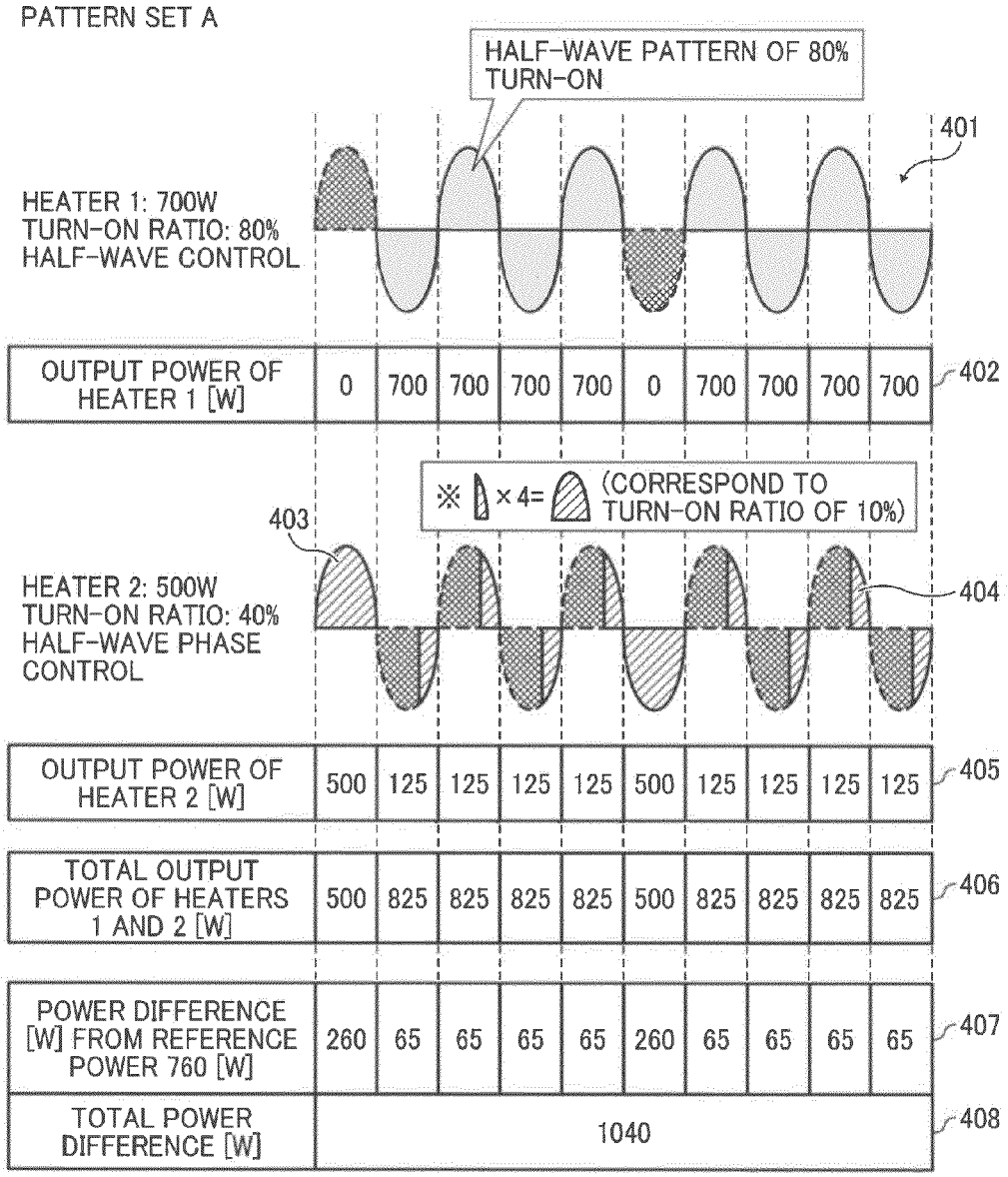
FIG. 5 is a diagram illustrating an example of pattern set A.
Figure 6:
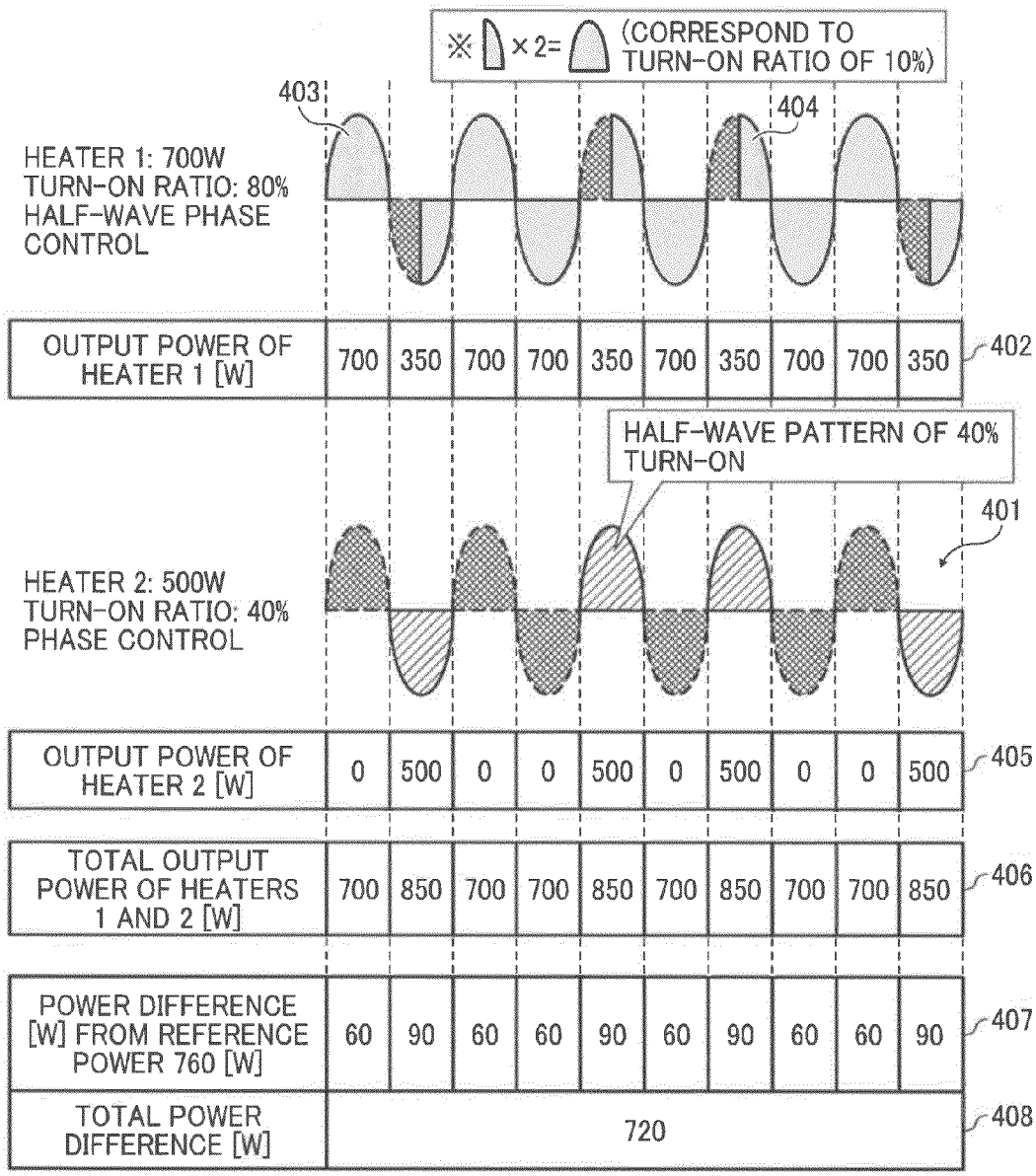
FIG. 6 is a diagram illustrating an example of pattern set B.

Next, a specific example of the heater control process will be discussed with reference to FIG. 5 and FIG. 6. FIG. 5 is a diagram illustrating an example of the pattern set A. FIG. 6 is a diagram illustrating an example of the pattern set B. An example where electrical power of the heater 1 and that of the heater 2 are 700 watts W and 500 W, respectively, and turn-on ratio of the heater 1 and that of the heater 2 are 80% and 40%, respectively, is discussed below.

As illustrated in FIG. 5, in the pattern set A, the heater 1 is subjected to half-wave control, and the heater 2 is subjected to half-wave phase control. According to the pattern set A, the heater 1 is turned-on according to a half-wave pattern 401 of 80%-turn-on and having a control period of ten half waves. The output-value calculating unit 152 calculates output power values 402 on a per-half-wave basis.

According to the pattern set A, first, the heater 2 is fully-turned-on at two half-waves 403 corresponding to two half-waves at which the heater 1 is turned off. In this example, the turn-on ratio of the heater 2 is 40%. Accordingly, the heater 2 needs to be 20%-turned-on at the remaining half-waves. Hence, according to phase duties 404, the heater 2 is partially turn-on at eight half-waves other than the two half-waves at which the heater 2 is turned-on, by equally dividing the remaining 20%-turn-on duty to be allocated to the eight half-waves. The phase duty represents a duty for allocating a partial turn-on to a half-wave by phase control. The output-value calculating unit 152 calculates output power values 405 on a per-half-wave basis.

The output-value calculating unit 152 calculates total output power values 406, each being a total of the output power values of the heaters 1 and 2 for one half-wave. The difference calculating unit 153 calculates difference values 407, each being an absolute value of the difference between the received reference power value and the total output power value 406 for one half-wave. In this example, it is assumed that the reference power is 760 W. The difference calculating unit 153 calculates a total power difference 408, being a total of the calculated differences over one control period, or, in other words, ten half waves.

A total power difference 408 of the pattern set B is calculated in a manner similar to that of the pattern set A but different from the same in that half-wave phase control is assigned to the heater 1 and half-wave control is assigned to the heater 2 (see FIG. 6).

The selecting unit 154 compares the total power difference of the pattern set A and that of the pattern set B and selects either one of the pattern sets having a smaller total power difference. In this example, the selecting unit 154 selects the pattern set B because the total power difference of the pattern set A and that of the pattern set B are 1,040 W and 720 W, respectively.

As mentioned above with reference to the pattern set A and the pattern set B, in the first embodiment, in a situation where half-wave control and half-wave phase control are independently assigned to two heaters, the heater, to which half-wave phase control is assigned, is controlled in this way:

(1) a full turn-on is allocated to a half wave corresponding to a half wave allocated with a turn-off of the other heater to which half-wave control is assigned; and (2) a remaining turn-on duty is equally divided to be allocated to the remaining half-waves, so that the heater is partially turned-on at the remaining half-waves according to the phase duties.

This allows a voltage drop in waveform, which can cause flicker to occur, to occur in two stages. The two-stage drop means that a total of output power values (total output power) per half wave of the two heaters has two values. For instance, in the pattern set A illustrated in FIG. 5, the total output power has two values: 500 W and 825 W. Similarly, in the pattern set B illustrated in FIG. 6, the total output power has two values: 700 W and 850 W.

On/off patterns are adjusted on a per half-wave basis in a control period of 10 half waves (100 ms when a 50-Hz AC source is employed) close to a frequency of 8.8 Hz (i.e., approximately 10 Hz), at which flicker perception may occur. Accordingly, heater on/off control not involving or involving little of this frequency band can be achieved. According to the first embodiment, of two pattern sets associated with each turn-on duty, one pattern set having the smaller difference from the reference power value is selected as discussed above. This allows difference in power from the reference power to be reduced, thereby further advantageously reducing flicker value.

Second Embodiment

In the first embodiment, the reference value, the differences, and the like are calculated based on electric power in lieu of voltages because a electric power value of heater and a voltage drop amount are in a proportional relationship. In a second embodiment according to the present embodiment, an example where the reference value and the like are calculated based on voltages is discussed. More specifically, in the second embodiment, an electric power value of heater are converted into a voltage drop amount, from which, in turn, an average value of voltages supplied to the apparatus over a predetermined period is calculated as a reference voltage value. Flicker reduction can be achieved by controlling the heaters so as to reduce difference between the reference voltage value and a dropped supply voltage value (output voltage value) upon performing heater control. Employment of the voltages allows the voltage drop amount to be corrected according to conditions related to heater on/off control, such as temperature and relative humidity, heater-on/off intervals, and temperature characteristics of the heaters. This makes it possible to estimate a voltage drop amount more accurately.

Figures 7, 8:
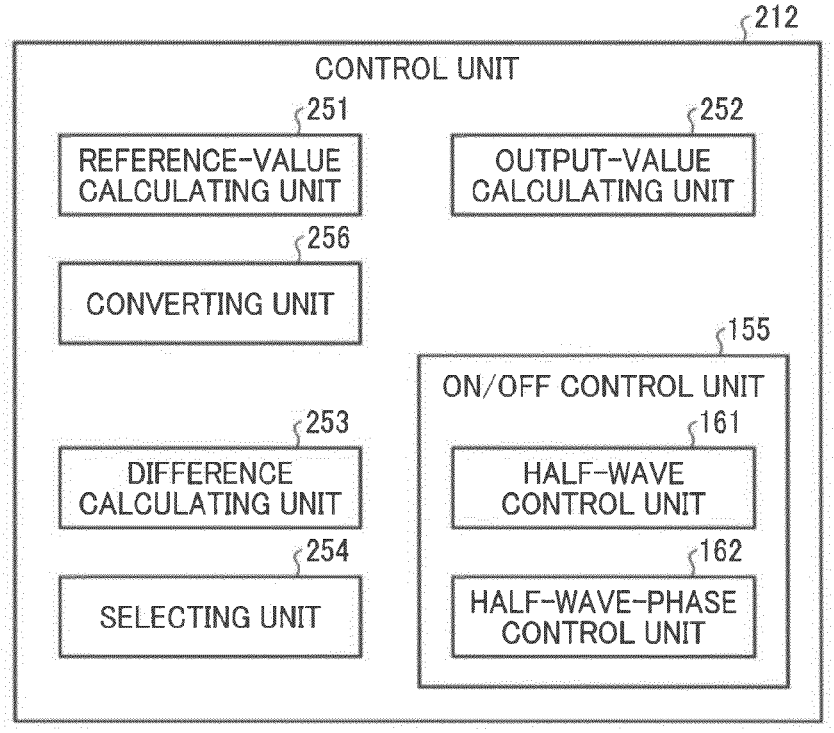
FIG. 7 is a functional block diagram of exemplary functions of a control unit according to a second embodiment of the present invention.
FIG. 8 is a diagram illustrating an example of a conversion table.

An image forming apparatus according to the second embodiment differs from that of the first embodiment in functions provided by the control unit. The image forming apparatus according to the second embodiment has overall configuration similar to that of the image forming apparatus 10 according to the first embodiment illustrated in FIG. 1, and repeated descriptions are omitted. FIG. 7 is a functional block diagram of exemplary functions of a control unit 212 according to the second embodiment. As illustrated in FIG. 7, the control unit 212 includes, as relevant functional elements, a reference-value calculating unit 251, an output-value calculating unit 252, a difference calculating unit 253, a selecting unit 254, the on/off control unit 155, and a converting unit 256.

The control unit 212 of second embodiment differs from the control unit 112 of the first embodiment in additionally including the converting unit 256 and in that functions of the reference-value calculating unit 251, the output-value calculating unit 252, the difference calculating unit 253 differ from those of their equivalents in the first embodiment. The on/off control unit 155 having functions similar to those of the first embodiment is denoted by the same reference numeral and repeated description is omitted.

The converting unit 256 converts power consumption values of the heaters (the halogen heaters 121A and 121B) into voltage drop amounts. For instance, the converting unit 256 accesses a conversion table in which power consumption values are associated with voltage drop amounts, thereby converting the power consumption values of the heaters into voltage drop amounts. The conversion table can be stored in, for instance, the storage unit 111. FIG. 8 is a diagram illustrating an example of the conversion table. As illustrated in FIG. 8, the conversion table stores therein power consumption values of heaters (fixation-heater power consumption) associated with voltage drop amounts.

The reference-value calculating unit 251 calculates a reference voltage representing an average of voltages applied to the image forming apparatus over a predetermined period of time (e.g., one minute). The reference-value calculating unit 251 first corrects the voltage drop amounts obtained by the converting unit 256 through conversion according to a turn-on duty and the temperature (environmental temperature) of a location where the image forming apparatus is placed. The reference-value calculating unit 251 calculates an average of the thus-corrected voltage drop amounts over the predetermined period of time. The reference-value calculating unit 251 subtracts the thus-calculated average from a no-load source voltage (e.g., 100 V) to obtain a reference voltage. The thus-obtained reference voltage can be stored in, for instance, the storage unit 111. Alternatively, the conversion table may be prepared and stored for each turn-on duty, so that voltage drop amounts can be obtained depending on the turn-on duty without using a turn-on coefficient for use in correcting a voltage drop amount.

The reference-value calculating unit 251 accesses a turn-on coefficient table in which, for instance, turn-on duties are associated with the turn-on coefficients, thereby retrieving a turn-on coefficient of a corresponding turn-on duty. The reference-value calculating unit 251 then corrects the voltage drop amounts by using the thus-retrieved turn-on coefficients. The reference-value calculating unit 251 accesses a temperature coefficient table in which, for instance, environmental temperatures are associated with coefficients (temperature coefficients) for use in correcting voltage drop amounts, thereby retrieving a temperature coefficient of a corresponding environmental temperature. The reference-value calculating unit 251 corrects the voltage drop amounts by using the thus-retrieved temperature coefficients. FIG. 9 is a diagram illustrating an example of the turn-on coefficient table. FIG. 10 is a diagram illustrating an example of the temperature coefficient table.

Meanwhile, the control unit 112 of the first embodiment can be configured to perform correction responsive to environmental temperature in calculation of the reference power. For instance, the reference-value calculating unit 151 can correct an electric power value supplied to the image forming apparatus in each control period by using a temperature coefficient and calculate, as the reference power value, an average of the corrected values of the electric power over a predetermined period of time.

The output-value calculating unit 252 calculates, for each of on/off patterns, output voltage values of the halogen heaters 121A and 121B to be turned-on according to the on/off patterns. The output voltage value represents a dropped voltage in each of the control period. The thus-calculated output voltages are stored in, for instance, the storage unit 111. The output-value calculating unit 252 first corrects, according to a turn-on duty and an environmental temperature, the voltage drop amount converted by the converting unit 256. The output-value calculating unit 252 subtracts the thus-calculated voltage drop amount from a no-load source voltage value to obtain an output voltage value. The thus-calculated output voltage value is stored in, for instance, the storage unit 111.

The difference calculating unit 253 calculates, for each of the two on/off patterns included in the two pattern sets, differences between the reference voltage calculated by the reference-value calculating unit 251 and the output voltages calculated by the output-value calculating unit 252.

The selecting unit 254 selects, from the pattern sets, one pattern set whose total of the differences calculated by the difference calculating unit 253 is smaller. For instance, the selecting unit 254 selects, from the two pattern sets, one pattern set whose total of differences is smaller. If there are three or more pattern sets, the selecting unit 254 selects one pattern set whose total of differences is smallest.

The heater control process performed by the image forming apparatus configured as mentioned above according to the second embodiment is similar to the heater control process illustrated in FIG. 4 according to the first embodiment except that voltage values (output voltage value and reference voltage value) are used in lieu of electric power values (output power values and reference power value), and repeated descriptions are omitted.

Figure 11:
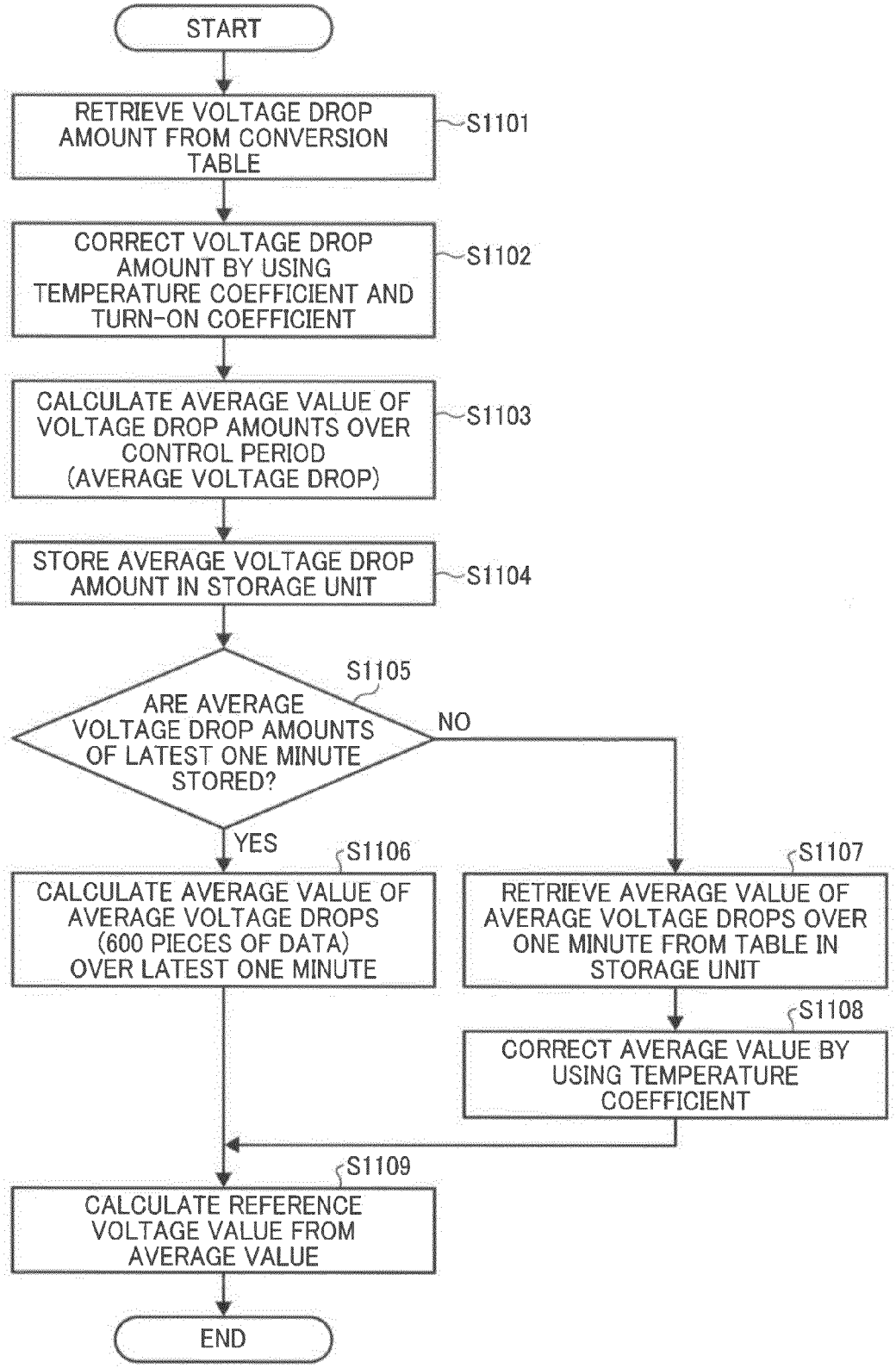
FIG. 11 is a flowchart illustrating an example procedure for a reference-value calculating process to be performed by a reference-value calculating unit according to the second embodiment.

A reference-value calculating process to be performed by the reference-value calculating unit 251 is discussed in detail below with reference to FIG. 11. FIG. 11 is a flowchart illustrating a procedure for the reference-value calculating process to be performed by the reference-value calculating unit 251 according to the second embodiment.

The converting unit 256 retrieves, from such a conversion table as illustrated in FIG. 8, a voltage drop amount corresponding to a power consumption of each of the heaters with respect to a turn-on duty of each of the heaters set for each control period (Step S1101). The reference-value calculating unit 251 accesses such a turn-on coefficient table as illustrated in FIG. 9 to retrieve a turn-on coefficient associated with a designated turn-on duty. The reference-value calculating unit 251 accesses such a temperature coefficient table as illustrated in FIG. 10 to retrieve a temperature coefficient associated with the environmental temperature. The environmental coefficient is to be detected by a temperature sensor or the like (not shown). The reference-value calculating unit 251 corrects each of the thus-obtained voltage drop amounts by using the temperature coefficient and the turn-on coefficient (Step S1102).

Per-half-wave voltage drop amounts are obtained through processing pertaining to Step S1101 and Step S1102. Subsequently, the reference-value calculating unit 251 calculates an average value (hereinafter, "average voltage drop") of voltage drop amounts over one control period based on a turn-on duty and the thus-obtained per-half-wave voltage drop amounts (Step S1103). How to calculate the average voltage drop will be discussed in detail later. The reference-value calculating unit 251 stores the thus-calculated average voltage drop in the storage unit 111 (Step S1104).

The reference-value calculating unit 251 stores, in the storage unit 111, the average voltage drops in the respective control periods within at least latest one minute. This allows further calculation of an average of the average voltage drops in the respective control periods over one minute. This average over one minute can be calculated every time when an operation mode is switched, alternatively, can be calculated irrespective of switching of an operation mode. For the former case, for instance, average voltage drops stored in the storage unit 111 are deleted when switching of an operation mode is made and thereafter average voltage drops obtained in an operation mode after the switching are accumulated.

Alternatively, average (average voltage) of dropped voltages, each being a voltage after occurrence of voltage drop, may be stored in lieu of average voltage drops and a reference voltage may be calculated based on the stored average voltage. Further alternatively, turn-on duties are stored on a per-control-period basis as history in lieu of the average voltage drops so that average voltage drops and an average value of the average voltage drops over one minute are calculated based on the thus-stored turn-on duties.

The reference-value calculating unit 251 determines whether average voltage drops within the latest one minute are stored in the storage unit 111 (Step S1105). If the average voltage drops are stored in the storage unit 111 (YES at Step S1105), the reference-value calculating unit 251 calculates an average value of the average voltage drops over the latest one minute (Step S1106). More specifically, if the control period is 100 ms, the number of data pieces of the average voltage drops per minute is 600. In this case, the reference-value calculating unit 251 obtains the average value of the average voltage drops over the latest one minute by dividing a sum of the latest average voltage drops by 600.

There are some cases, such as at power on or on returning from power saving mode, where average voltage drops of the latest one minute are not present. For such a case, the reference-value calculating unit 251 determines that average voltage drops over the latest one minute are not stored in the storage unit 111 (NO at Step S1105). In this case, the reference-value calculating unit 251 obtains a value corresponding to an average value of the average voltage drops over the latest one minute by accessing a table in the storage unit 111 (Step S1107).

For instance, voltage drop amounts determined in advance for each operation mode can be stored in this table. In this case, the reference-value calculating unit 251 retrieves a voltage drop amount associated with a currently employed operation mode and uses the voltage drop amount as an average value of average voltage drops over one minute.

The reason why the voltage drop amounts are stored for each operation mode is discussed below. Flicker measurement is performed using a reference value, being an average value of source voltages applied to target equipment, detected at predetermined time intervals. When the equipment has a plurality of optional operation modes of different power consumptions, the value of the reference voltage varies depending on the operation mode. More specifically, generally, in an operation mode of relatively large power consumption, a source voltage drop is relatively high, causing the reference voltage, or the average voltage, to be low whereas, in an operation mode of relatively small power consumption, a source voltage drop is relatively low, causing the reference voltage to be high. Under such a circumstance, the voltage drop amounts are desirably stored for each operation mode so that an appropriate reference value can be calculated responsive to an operation mode.

Meanwhile, average voltage values can be stored for each operation mode in place of storing the voltage drop amounts for each operation mode. This allows voltage drop amounts to be calculated from an unloaded source voltage value and the average voltage value.

The reference-value calculating unit 251 corrects the value retrieved from the table and corresponding to the average by using a temperature coefficient assigned to the environmental temperature (Step S1108). This process makes it possible to estimate a voltage drop amount more accurately.

The reference-value calculating unit 251 calculates a reference voltage value from the average value of the average voltage drops obtained at Step S1106 or the average value (the value corresponding thereto) corrected at Step S1108 (Step S1109). More specifically, the reference-value calculating unit 251 subtracts the average value from the unloaded source voltage value, thereby obtaining the reference voltage value.

A specific example of the reference-value calculating process is discussed below with reference to FIG. 12 to FIG. 14. In this exemplary reference-value calculation, it is assumed that control period of one heater (800 W) is 100 ms and turn-on duty of the heater is set to 60%. Meanwhile, known control schemes for controlling power supply to a heater includes cycle control, phase control, and on/off control. In the example discussed below, it is assumed that heater control (half-wave control) in which a turn-on or a turn-off is allocated to each half-wave within a control period made up of 10 half-waves. Half-wave control achieves variable power supply control by changing a turn-on ratio within the control period. In this example, when a 60%-turn-on duty is employed, the heater is turned-on at six half-waves out of the ten half-waves.

Figure 12:
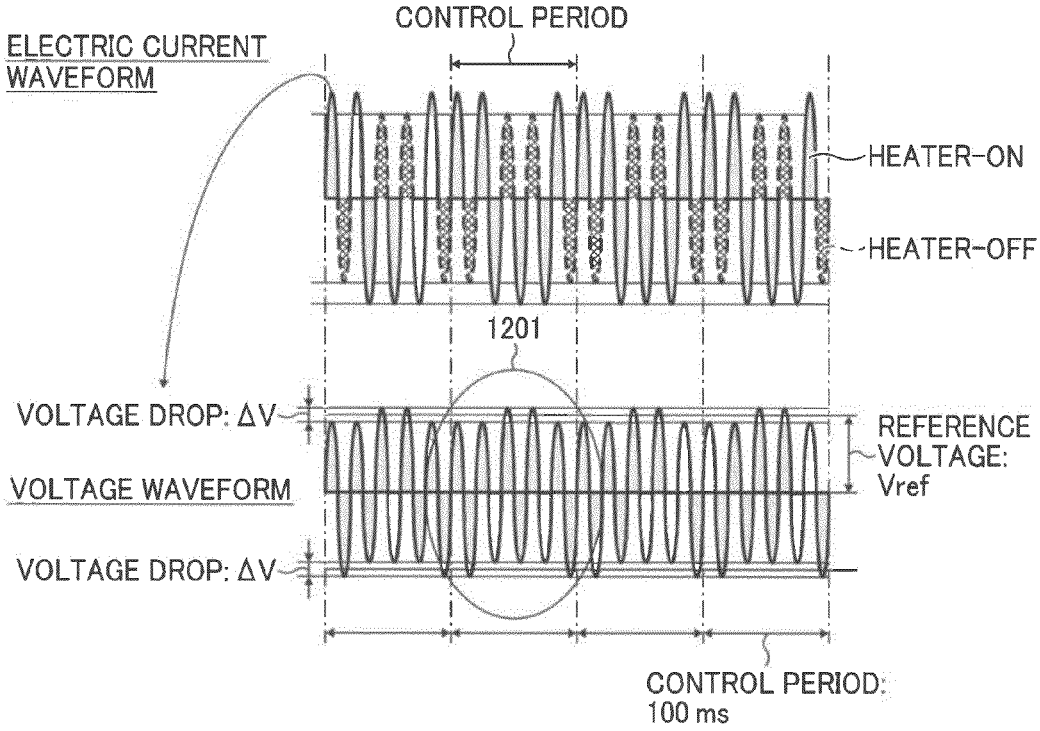
FIG. 12 is a diagram illustrating an electric current waveform and a voltage waveform of a heater in a 60%-turn-on duty.

FIG. 12 is a diagram illustrating an electric current waveform (the graph on the top) and a voltage waveform (the graph on the bottom) of a heater in the 60%-turn-on duty. As illustrated in FIG. 12, an electric current passing through the heater when the heater is turned-on causes a voltage drop to occur across the power supply line. This voltage drop amount ($\Delta V$) differs depending on heater power and turn-on duty. More specifically, the voltage drop amount varies depending on the heater power because the electric current passing through the power supply line increases as the heater power increases, causing a voltage drop amount due to line impedance to increase. FIG. 8 mentioned above shows that as the fixation-heater power consumption increases, the voltage drop amount increases.

The reason why the voltage drop amount varies depending on the turn-on duty is that on/off intervals of the heater varies depending on the turn-on duty and that the impedance decreases as the temperature of the heater decreases during a turn-off period, resulting in an increase in inrush current. In short, as the turn-on duty decreases, turn-off-periods becomes longer, causing a voltage drop amount to be large. FIG. 9 mentioned above shows that the turn-on coefficient increases as the turn-on duty decreases, causing the voltage drop amount to be large.

A heater has a property of being cooled during a turn-off period of as short as tens of milliseconds, causing the impedance to decrease. Accordingly, the environmental temperature can affect the way the heater is cooled during turn-off periods, causing a voltage drop amount to vary depending on an operation mode. Hence, the reference-value calculating unit 251 corrects a voltage drop amount by using a temperature coefficient that varies depending on an environmental temperature as mentioned above. FIG. 10 mentioned above shows that the temperature coefficient increases as the environmental temperature increases, causing the voltage drop amount to be large.

Values shown in FIG. 8 to FIG. 10 are values pertaining to an example heater. These values can vary depending on a gas contained in a glass tube of the heater, components of the heater, and the like, and therefore are desirably adjusted depending on characteristics of a target heater. With reference to FIG. 8, a voltage drop amount when a heater of 800 W is turned-on is 3.1 V (Step S1101 of FIG. 11). With reference to FIG. 9, an turn-on coefficient when this heater is used in a 60%-turn-on duty is 1.2. With reference to FIG. 10, a temperature coefficient for usage at room temperature is 1.0. Hence, a voltage drop amount per half-wave under this condition is calculated from the following Equation (1) and found to be 3.72 V.

$$3.1(V)\times 1.2\times 1.0=3.72(V) \quad (1)$$

The reference-value calculating unit 251 calculates an average voltage drop amount ($\Delta V_{ref}$) over one control period of 100 ms (ten half-waves) (Step S1103). In this example, because the turn-on duty is 60%, a voltage drop of 3.72 V occurs for six half-waves out of the ten half-waves. Hence, the average voltage drop amount can be calculated from the following Equation (2).

$$3.72(V)\times 6(\text{half-waves})/10(\text{half-waves})=2.232(V) \quad (2)$$

Figure 13:
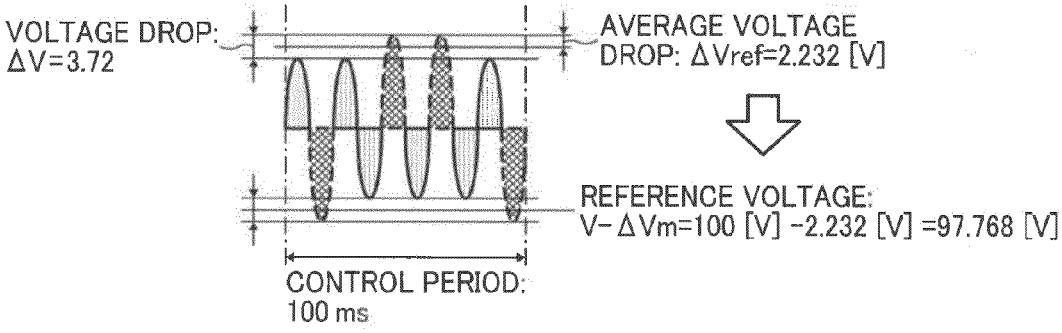
FIG. 13 is a diagram illustrating a detail of a portion, of one control period, of the waveform illustrated in FIG. 12.

FIG. 13 is a diagram illustrating a waveform 1201, being a portion, of one control period, of the waveform illustrated in FIG. 12. FIG. 14 is a diagram illustrating exemplary calculation of an average voltage drop amount over this one control period. FIG. 13 illustrates an example where a heater is to be turned-on at the first, third, fourth, sixth, eighth, and ninth half-waves out of the ten half-waves when the turn-on duty is 60%. FIG. 14 gives voltage drop amounts at these half-waves. Accordingly, an average value (average voltage drop) of the voltage drop amounts of the ten half-waves is 2.232 as given in FIG. 14.

A reference voltage value used in flicker measurement is defined to be an average of supply voltages over one minute. Accordingly, a reference voltage to be estimated in the second embodiment is similarly calculated from an average of voltages over one minute. When the control period is set to 100 ms, after calculating an average ($\Delta V_m$) of the latest 600 average voltage drop amounts, each obtained from Equation (2), a reference voltage $V_{ref}$ is calculated by substituting this average ($\Delta V_m$) of the average voltage drops over one minute into Equation (3).

$$V_{ref}=(\text{no-load voltage})-\Delta V_m \quad (3)$$

FIG. 13 illustrates an example of calculation of the reference voltage $V_{ref}$ in a situation where $\Delta V_m$ is 2.232, which is equal to the average voltage drop ($\Delta V_{ref}$) over one control period (ten half-waves). The reference voltage $V_{ref}$ can be obtained from the following equation: $V_{ref}$=(no-load voltage)−$\Delta V_m$(=$\Delta V_{ref}$). Hence, the reference voltage $V_{ref}$ is found to be: 100(V)−2.232(V)=97.768(V).

As discussed above, in the second embodiment, the reference voltage value is calculated from voltage drop amounts obtained in the latest one minute. The reference voltage value is updated every control period at which a turn-on duty of a heater is updated, or every integral multiple of the control period. This allows relatively accurate estimation of voltage drop amounts, thereby increasing accuracy of the reference voltage.

At a period immediately after a start of operation, such as at power-on or on returning from power saving mode, the reference voltage value cannot be calculated because there are no data pertaining to the latest one minute. For such a period, the reference voltage value can be calculated by retrieving a corresponding one of voltage drop amounts stored in advance in the storage unit 111 for each operation mode. Although such a voltage drop amount stored in advance in this way can be used as it is, the voltage drop amount can be further corrected by using a temperature coefficient that depends on the environmental temperature. This correction allows further improvement in accuracy.

For a situation where a plurality of heaters are used, a reference voltage value can be obtained by calculating a voltage drop amount of each heater from power consumption and turn-on duty of the heater and then subtracting a sum of the voltage drop amounts from a no-load voltage value.

For a situation where phase control is applied to a heater, a reference voltage can be obtained as in the half-wave control by retrieving, from a table, an average value of per-half-wave voltage drops or calculating the same.

In the embodiments discussed above, the reference value has been calculated only by taking heater control into account because fixation-heater power consumption is a dominant factor of voltage variations of the overall apparatus. However, in some operation mode, other factors related to direct current (DC) loads, such as a motor, a clutch, a solenoid, and the control board 110, relative to an input voltage drop amount are negligible. For such a case, accuracy can be further improved by taking voltage drop amount related to these loads or the like into account in calculation of the reference voltage value.

According to the first embodiment and the second embodiment, a reference voltage value is obtained in the apparatus by storing voltage variations in power supply voltage over the latest predetermined period of time in a form of history information and calculating an average of the voltage variations of the power supply voltage based on the history information. Even when a fixation control duty is changed by, for example, switching of an operation mode, the reference voltage value can be calculated relatively accurately responsive to the change because the voltage variation amounts are estimated according to turn-on duty of a heater. Furthermore, the reference voltage value can be updated every control period. This allows the reference voltage value to be calculated relatively highly accurately responsive to changes in environment of the location and operation mode.

Computer program instructions (hereinafter, "program") to be executed by the heater controller and the image forming apparatus according to the first embodiment and the second embodiment can be provided as being preinstalled in a ROM or the like.

The program to be executed by the heater controller and the image forming apparatus according to the first embodiment and the second embodiment can be provided as being recorded in a computer-readable recording medium such as a compact disc-read-only memory (CD-ROM), a flexible disk (FD), a compact disc recordable (CD-R), or a digital versatile disk (DVD) in an installable or executable format.

The program to be executed by the heater controller and the image forming apparatus according to the first embodiment and the second embodiment can be stored in, in lieu of the recording medium, a computer that is connected to a network, such as the Internet, so that the computer program can be downloaded from the computer via the network. The program to be executed by the heater controller and the image forming apparatus according to the first embodiment and the second embodiment can be configured so as to be provided or distributed via a network, such as the Internet.

The program to be executed by the heater controller and the image forming apparatus according to the first embodiment and the second embodiment has a module structure that includes the units (the reference-value calculating unit, the output-value calculating unit, the difference calculating unit, the selecting unit, and the on/off control unit) discussed above. In the context of actual hardware, the CPU (processor) reads the program from the storage medium and executes the program to load the units on a main memory device, thereby generating the units on the main memory device.

According to an aspect of the present invention, flicker level can be advantageously lessened even when a plurality of heaters are used.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A heater controller that performs on/off control of a plurality of heaters, the heater controller comprising:

a storage unit that stores therein a plurality of pattern sets, wherein each of the pattern sets includes a plurality of heater-on/off patterns for respectively controlling the heaters, and each of the heater-on/off patterns is set in terms of a predetermined pattern control period;

a reference-value calculating unit that calculates a reference value representing an average of values of electric power supplied to an image forming apparatus over a predetermined period of time corresponding to electric power which is supplied;

an output-value calculating unit that calculates, for each of the pattern sets, an output power value to be supplied to the heaters when the heaters are turned-on according to the heater-on/off patterns included in the pattern set;

a difference calculating unit that calculates, for each of the pattern sets, a difference between the reference value and the output power value;

a selecting unit that selects, from the pattern sets, one pattern set having a smallest difference; and an on/off control unit that performs on/off control of the heaters according to the heater-on/off patterns included in the pattern set selected by the selecting unit, respectively, wherein:

each of the heater-on/off patterns is made up of a plurality of half-waves, each of which is a half of a cycle of an alternating current supply voltage to be supplied to the heaters, the output-value calculating unit calculates the output power value for each of the half-waves within one control period, and the difference calculating unit calculates a total of differences between the reference value and each output power value calculated for each of the half-waves in the one control period.

2. The heater controller of claim 1, wherein, a first heater out of the heaters is subjected to half-wave control by using one of the heater-on/off patterns in which a full turn-on or a full turn-off is allocated to each of the half-waves, and a second heater is subjected to half-wave phase control by using another pattern in which a full turn-on or a partial turn-on is allocated to each of the half-waves.

3. The heater controller of claim 1, wherein the reference-value calculating unit calculates the reference value representing an average of values of electric power supplied to the image forming apparatus over a predetermined period of time corresponding to electric power which is supplied, and the output-value calculating unit calculates the output power value to be supplied to the heaters on a per-control-period basis when the heaters are turned on according to the heater-on/off patterns.

4. The heater controller of claim 3, wherein the reference-value calculating unit calculates the reference value on the per-control-period basis, the reference value representing an average of values of electric power supplied to the image forming apparatus over a latest predetermined period of time corresponding to electric power which is supplied.

5. The heater controller of claim 3, wherein the reference-value calculating unit corrects the values of the electric power supplied to the image forming apparatus over the predetermined period of time corresponding to electric power which is supplied according to an environmental temperature to calculate a reference value representing an average of the corrected values of electric power, the environmental temperature being an ambient temperature of an image forming apparatus.

6. The heater controller of claim 1, wherein when there are two or more pattern sets having the smallest difference out of the pattern sets, the selecting unit selects, from the two or more pattern sets, one pattern set in which a heater having a smallest turn-on ratio is subjected to half-wave control, the half-wave control being performed by using one of the heater-on/off patterns in which a full turn-on or a full turn-off is allocated to each of the half-waves.

7. The heater controller of claim 1, wherein when there are two or more pattern sets having the smallest difference out of the pattern sets, the selecting unit selects, from the two or more pattern sets, one pattern set in which a heater having smallest power consumption is subjected to half-wave control, the half-wave control being performed by using one of the heater-on/off patterns in which a full turn-on or a full turn-off is allocated to each of the half-waves.

8. The heater controller of claim 1, wherein when there are two or more pattern sets having the smallest difference out of the pattern sets, the selecting unit selects, as the one pattern set, a pattern set having been selected for an immediately preceding control period.

9. An image forming apparatus comprising:

the heater controller according to claim 1;

a fixing unit that includes the heaters; and an alternating-current power supply for applying an alternating current voltage to the heaters.

10. A heater control method to be performed by a heater controller to perform on/off control of a plurality of heaters, the heater controller including a memory having stored therein a plurality of pattern sets, wherein each of the pattern sets includes a plurality of heater-on/off patterns for respectively controlling the heaters, and each of the heater-on/off patterns is set in terms of a predetermined pattern control period, the method comprising:

calculating a reference value representing an average of values of electric power supplied to an image forming apparatus over a predetermined period of time corresponding to electric power which is supplied;

calculating, for each of the pattern sets, an output power value to be supplied to the heaters when the heaters are turned-on according to the heater-on/off patterns included in the pattern set;

calculating, for each of the pattern sets, a difference between the reference value and the output power value;

selecting, from the pattern sets, one pattern set having the smallest difference; and performing on/off control of the heaters according to the heater-on/off patterns included in the pattern set selected at the selecting, respectively, wherein:

each of the heater-on/off patterns is made up of a plurality of half-waves, each of which is a half of a cycle of an alternating current supply voltage to be supplied to the heaters, the calculating of the output power value calculates the output power value for each of the half-waves within one control period, the calculating of the difference calculates a total of differences between the reference value and each output power value calculated for each of the half-waves in the one control period, and when there are two or more pattern sets having the smallest difference out of the pattern sets, the selecting selects, from the two or more pattern sets, one pattern set in which a heater having a smallest turn-on ratio is subjected to half-wave control, the half-wave control being performed by using one of the heater-on/off patterns in which a full turn-on or a full turn-off is allocated to each of the half-waves.

11. A heater control method to be performed by a heater controller to perform on/off control of a plurality of heaters, the heater controller including a memory having stored therein a plurality of pattern sets, wherein each of the pattern sets includes a plurality of heater-on/off patterns for respectively controlling the heaters, and each of the heater-on/off patterns is set in terms of a predetermined pattern control period, the method comprising:

calculating a reference value representing an average of values of electric power supplied to an image forming apparatus over a predetermined period of time corresponding to electric power which is supplied;

calculating, for each of the pattern sets, an output power value to be supplied to the heaters when the heaters are turned-on according to the heater-on/off patterns included in the pattern set;

calculating, for each of the pattern sets, a difference between the reference value and the output power value;

selecting, from the pattern sets, one pattern set having the smallest difference; and performing on/off control of the heaters according to the heater-on/off patterns included in the pattern set selected at the selecting, respectively, wherein:

each of the heater-on/off patterns is made up of a plurality of half-waves, each of which is a half of a cycle of an alternating current supply voltage to be supplied to the heaters, the calculating of the output power value calculates the output power value for each of the half-waves within one control period, the calculating of the difference calculates a total of differences between the reference value and each output power value calculated for each of the half-waves in the one control period, and when there are two or more pattern sets having the smallest difference out of the pattern sets, the selecting selects, from the two or more pattern sets, one pattern set in which a heater having smallest power consumption is subjected to half-wave control, the half-wave control being performed by using one of the heater-on/off patterns in which a full turn-on or a full turn-off is allocated to each of the half-waves.

* * * * *